US005897206A

United States Patent [19]

Hall

[11] Patent Number: 5,897,206

[45] Date of Patent: Apr. 27, 1999

[54] AGITATOR AND AGITATOR ASSEMBLY

[75] Inventor: Michael W. Hall, Sidney, Ohio

[73] Assignee: Peerless Machinery Corporation, Sidney, Ohio

[21] Appl. No.: 08/932,692

[22] Filed: Sep. 18, 1997

[51] Int. Cl.[6] ..... B01F 7/24

[52] U.S. Cl. ..... 366/320; 366/300; 366/301

[58] Field of Search ..... 366/320, 353, 366/325.8, 325.9, 297, 97, 300, 292

[56] References Cited

U.S. PATENT DOCUMENTS

| | | | |
|---|---|---|---|
| 540,962 | 6/1895 | Duhrkop . | |
| 907,748 | 12/1908 | Darling . | |
| 4,733,607 | 3/1988 | Star et al. | 99/348 |
| 4,859,074 | 8/1989 | Asai et al. | 366/97 |
| 5,083,506 | 1/1992 | Horn et al. | 99/348 |
| 5,228,775 | 7/1993 | Horn et al. | 366/278 |
| 5,230,561 | 7/1993 | Nishimi et al. | 366/97 |
| 5,292,186 | 3/1994 | Kubo et al. | 366/97 |
| 5,299,865 | 4/1994 | Presnell | 366/300 |
| 5,549,384 | 8/1996 | Reynolds | 366/320 |

FOREIGN PATENT DOCUMENTS

| | | | |
|---|---|---|---|
| 257135 | 1/1920 | Germany | 366/320 |

*Primary Examiner*—Tony G. Soohoo
*Attorney, Agent, or Firm*—Killworth, Gottman, Hagan & Schaeff, LLP

[57] ABSTRACT

An agitator for providing uniform and rapid material mixing is provided comprising a first sweep blade mechanically coupled to a second sweep blade. The first sweep blade extends from a first sweep blade origin to a first sweep blade terminus along a first substantially helical path defined about a first helical axis. The second sweep blade extends from a second sweep blade origin to a second sweep blade terminus along a second substantially helical path defined about a second helical axis. The respective orientations of the first sweep blade along the first substantially helical path and the second sweep blade along the second substantially helical path define a first flow direction extending from the first sweep blade origin to the second sweep blade terminus. An agitator assembly is provided comprising a first agitator, a second agitator, a mixing bowl enclosing the first and second agitators, and a driving assembly coupled to the first and second agitators. The second agitator is oriented substantially parallel to the first agitator. The first agitator defines a first flow direction extending from the first sweep blade origin to the second sweep blade terminus. The second agitator defines a return flow direction extending from the third sweep blade origin to the fourth sweep blade terminus. The return flow direction is opposite the first flow direction.

29 Claims, 5 Drawing Sheets

AGITATOR AND AGITATOR ASSEMBLY

BACKGROUND OF THE INVENTION

The present invention relates to an agitator and an agitator assembly for mixing materials. More particularly, the present invention relates to dough mixing and an agitator designed to provide for more uniform and rapid dough mixing within a mixing bowl.

FIG. 5 illustrates a conventional agitator assembly 2 comprising a pair of agitator shafts 4 and a set of sweep blades 6 mounted thereto. The shafts are caused to rotate in a mixing direction 8. Unfortunately, some mixing discontinuities may occur in the prior art agitator assembly 2 because the flow of material in the vicinity of the agitator assembly 2 tends to be focused at the center of the agitator assembly, see directional arrows 3. Material at the periphery of a mixing bowl in which the agitator assembly 2 is positioned is under mixed and material at the center of such a mixing bowl is over mixed. Further, the focused flow is not conducive to an efficient and rapid mixing operation.

Accordingly, there is a need for an agitator and an agitator assembly that ensures that materials are mixed uniformly throughout the mixing bowl. There is also a need for an agitator design that yields improved mixing rates within a mixing bowl.

BRIEF SUMMARY OF THE INVENTION

This need is met by the present invention wherein an agitator and agitator assembly are provided incorporating an improved sweep blade design that creates a substantially circuitous flow pattern within a mixing bowl.

In accordance with one embodiment of the present invention, an agitator is provided comprising an agitator shaft and first and second sweep blades mounted to the agitator shaft. The agitator shaft defines an axis of rotation extending from a first end of the agitator shaft to a second end of the agitator shaft.

The first sweep blade includes a first sweep blade origin, a first sweep blade terminus, and a first sweep blade span. The first sweep blade origin is secured to the agitator shaft proximate the first end of the agitator shaft and defines a first origin surface that is inclined relative to a plane normal to the axis of rotation. The first sweep blade terminus defines a first terminal surface that is inclined relative to a plane normal to the axis of rotation. The first sweep blade span extends from the first sweep blade origin to the first sweep blade terminus and defines a first span surface. The first span surface is inclined relative to a plane normal to the axis of rotation.

The second sweep blade includes a second sweep blade origin, a second sweep blade terminus, and a second sweep blade span. The second sweep blade origin defines a second origin surface that is inclined relative to a plane normal to the axis of rotation. The second sweep blade terminus is secured to the agitator shaft proximate the second end of the agitator shaft and defines a second terminal surface. The second sweep blade span extends from the second sweep blade origin to the second sweep blade terminus and defines a second span surface that is inclined relative to a plane normal to the axis of rotation.

Preferably, the inclination of the first sweep blade origin, the first sweep blade terminus, the first sweep blade span, the second sweep blade origin, and the second sweep blade span defines a first flow direction extending from one end of the agitator shaft to another end of the agitator shaft. The first flow direction may extend from the first end of the agitator shaft to the second end of the agitator shaft. The first flow direction corresponds to rotation of the agitator shaft in a positive direction about the axis of rotation and the second sweep blade origin preferably leads the first sweep blade terminus in the positive direction. The second sweep blade origin and the first sweep blade terminus may be separated by less than 180° with respect to the axis of rotation. Preferably, the second sweep blade origin and the first sweep blade terminus are separated by about 120° with respect to the axis of rotation.

The first origin surface may be inclined at a first angle, the first terminal surface may be inclined at a second angle, and the first angle may be is greater than the second angle such that the slope of the first sweep blade decreases from the first end of the agitator shaft in the direction of the second end of the agitator shaft. The first angle may be about 50° and the second angle is about 30°. Further, the second origin surface may be inclined at a third angle that is approximately equal to the first angle. The second terminal surface may be substantially parallel to the axis of rotation and may define a second flow direction substantially perpendicular to the first flow direction.

The first sweep blade origin and the first sweep blade terminus may be separated by about 120° with respect to the axis of rotation, such that the first sweep blade occupies approximately one third of a 360° arc defined about the axis of rotation. Similarly, the second sweep blade origin and the second sweep blade terminus may be separated by about 120° with respect to the axis of rotation, such that the second sweep blade occupies approximately one third of the 360° arc. Further, the first sweep blade and the second sweep blade may occupy substantially the same portion of the 360° arc.

The agitator shaft may comprise a substantially linear agitator shaft, a first hub, a second hub, and a third hub positioned along the agitator shaft. The first sweep blade origin may be secured to the first hub, the first sweep blade terminus and the second sweep blade origin may be secured to the second hub, and the second sweep blade terminus may be secured to the third hub. The second hub is preferably positioned equidistant from the first hub and the third hub.

In accordance with another embodiment of the present invention, an agitator is provided comprising a first sweep blade mechanically coupled to a second sweep blade. The first sweep blade extends from a first sweep blade origin to a first sweep blade terminus along a first substantially helical path defined about a first helical axis. The second sweep blade extends from a second sweep blade origin to a second sweep blade terminus along a second substantially helical path defined about a second helical axis. The respective orientations of the first sweep blade along the first substantially helical path and the second sweep blade along the second substantially helical path define a first flow direction extending from the first sweep blade origin to the second sweep blade terminus.

The second sweep blade terminus may include a second terminal surface that is substantially parallel to the second helical axis. The second terminal surface may define a second flow direction substantially perpendicular to the second helical axis. In contrast, the first sweep blade terminus may include a first terminal surface that is inclined relative to a plane normal to the first helical axis.

The first helical axis and the second helical axis may define a common helical axis. The first sweep blade origin and the second sweep blade terminus may be positioned at opposite ends of the common helical axis. The first sweep blade terminus and the second sweep blade origin may be positioned at substantially the same point along the common helical axis. The flow direction corresponds to rotation of the first sweep blade and the second sweep blade in a positive direction about a common helical axis. The second sweep blade origin preferably leads the first sweep blade terminus in the positive direction. The second sweep blade origin and the first sweep blade terminus may be separated by less than 180° with respect to the common helical axis.

The slope of the first sweep blade along the first helical path, relative to a plane normal to the first helical axis, may decrease from the first sweep blade origin to the first sweep blade terminus. Preferably, the slope decreases from about 50° to about 30°. The slope of the second helical path may decrease from the second sweep blade origin to the second sweep blade terminus, and the slope at the first sweep blade origin may be approximately equal to the slope at the second sweep blade origin.

The first sweep blade origin and the first sweep blade terminus may be separated by about 120° with respect to the common helical axis, such that the first sweep blade occupies approximately one third of a 360° arc defined about the common helical axis. Similarly, the second sweep blade origin and the second sweep blade terminus are separated by about 120° with respect to the common helical axis, such that the second sweep blade occupies approximately one third of the 360° arc.

Preferably, the first sweep blade and the second sweep blade occupy substantially the same one third portion of the 360° arc.

In accordance with yet another embodiment of the present invention, an agitator assembly is provided comprising a first agitator, a second agitator, a mixing bowl enclosing the first and second agitators, and a driving assembly coupled to the first and second agitators. The first agitator comprises a first sweep blade mechanically coupled to a second sweep blade. The first sweep blade extends from a first sweep blade origin to a first sweep blade terminus along a first substantially helical path defined about a first helical axis. The second sweep blade extends from a second sweep blade origin to a second sweep blade terminus along a second substantially helical path defined about a second helical axis. The respective orientations of the first sweep blade along the first substantially helical path and the second sweep blade along the second substantially helical path define a first flow direction extending from the first sweep blade origin to the second sweep blade terminus.

The second agitator is oriented substantially parallel to the first agitator and comprises a third sweep blade mechanically coupled to a fourth sweep blade. The third sweep blade extends from a third sweep blade origin to a third sweep blade terminus along a third substantially helical path defined about a third helical axis. The fourth sweep blade extends from a fourth sweep blade origin to a fourth sweep blade terminus along a fourth substantially helical path defined about a fourth helical axis. The respective orientations of the third sweep blade along the third substantially helical path and the fourth sweep blade along the fourth substantially helical path define a return flow direction extending from the third sweep blade origin to the fourth sweep blade terminus. The return flow direction is opposite the first flow direction.

The second sweep blade terminus may include a second terminal surface that is substantially parallel to the second helical axis. Similarly, the fourth sweep blade terminus may include a fourth terminal surface that is substantially parallel to the fourth helical axis. The respective orientations of the first sweep blade, the second sweep blade, the second terminal surface, the third sweep blade, the fourth sweep blade, and the fourth terminal surface define a substantially circuitous flow path extending from the first sweep blade origin, past the second, third and fourth sweep blades, and returning to the first sweep blade origin.

The first agitator and the second agitator are preferably substantially identical in structure and the second sweep blade terminus and the fourth sweep blade terminus are preferably positioned at opposite ends of the mixing bowl. The driving assembly is preferably operative to rotate the first and second agitators in a negative direction.

Accordingly, it is an object of the present invention to provide an agitator and an agitator assembly wherein more uniform and rapid mixing within a mixing bowl is provided. Other objects of the present invention will be apparent in light of the description of the invention embodied herein.

DETAILED DESCRIPTION OF THE PREFERRED EMBODIMENTS

Figure 1:
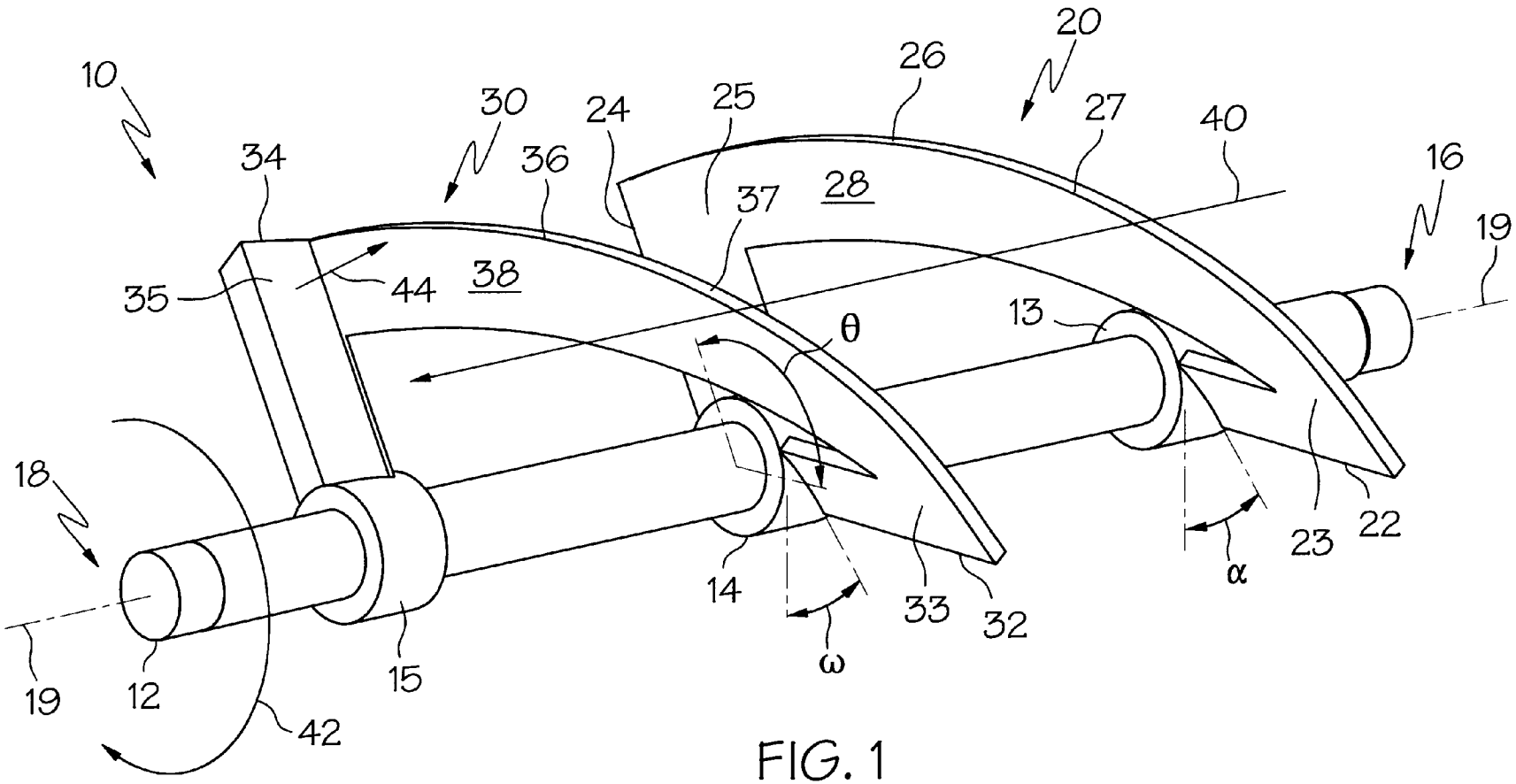
FIG. 1 is a perspective view of an agitator according to the present invention.

An agitator 10 according to the present invention is illustrated in FIGS. 1–4, where like structure is referenced by like reference numerals. The agitator 10 comprises a substantially linear agitator shaft 12 defining an axis of rotation 19 extending from a first end 16 of the agitator shaft 12 to a second end 18 of the agitator shaft 12. A first sweep blade 20 and a second sweep blade 30 are mounted to the agitator shaft 12. The first sweep blade 20 includes a first sweep blade origin 22, a first sweep blade terminus 24, and a first sweep blade span 26. Similarly, the second sweep blade 30 includes a second sweep blade origin 32, a second sweep blade terminus 34, and a second sweep blade span 36.

The first sweep blade origin 22 is secured to the agitator shaft 12 proximate the first end 16 of the agitator shaft 12 and defines a first origin surface 23. The first origin surface 23 is inclined relative to a plane normal to the axis of rotation 19. Similarly, the first sweep blade terminus 24 defines a first terminal surface 25 that is inclined relative to a plane normal to the axis of rotation 19. The first sweep blade span 26 extends from the first sweep blade origin 22 to the first sweep blade terminus 24 and defines a first span surface 28 which is also inclined relative to a plane normal to the axis of rotation 19. The second sweep blade origin 32 defines a second origin surface 33 that is inclined relative to a plane normal to the axis of rotation 19. The second sweep blade terminus 34 is secured to the agitator shaft 12 proximate the second end 18 of the agitator shaft 12 and defines a second terminal surface 35. The second sweep blade span 36 extends from the second sweep blade origin 32 to the second sweep blade terminus 34 and defines a second span surface 38 that is inclined relative to a plane normal to the axis of rotation 19.

Figure 2:
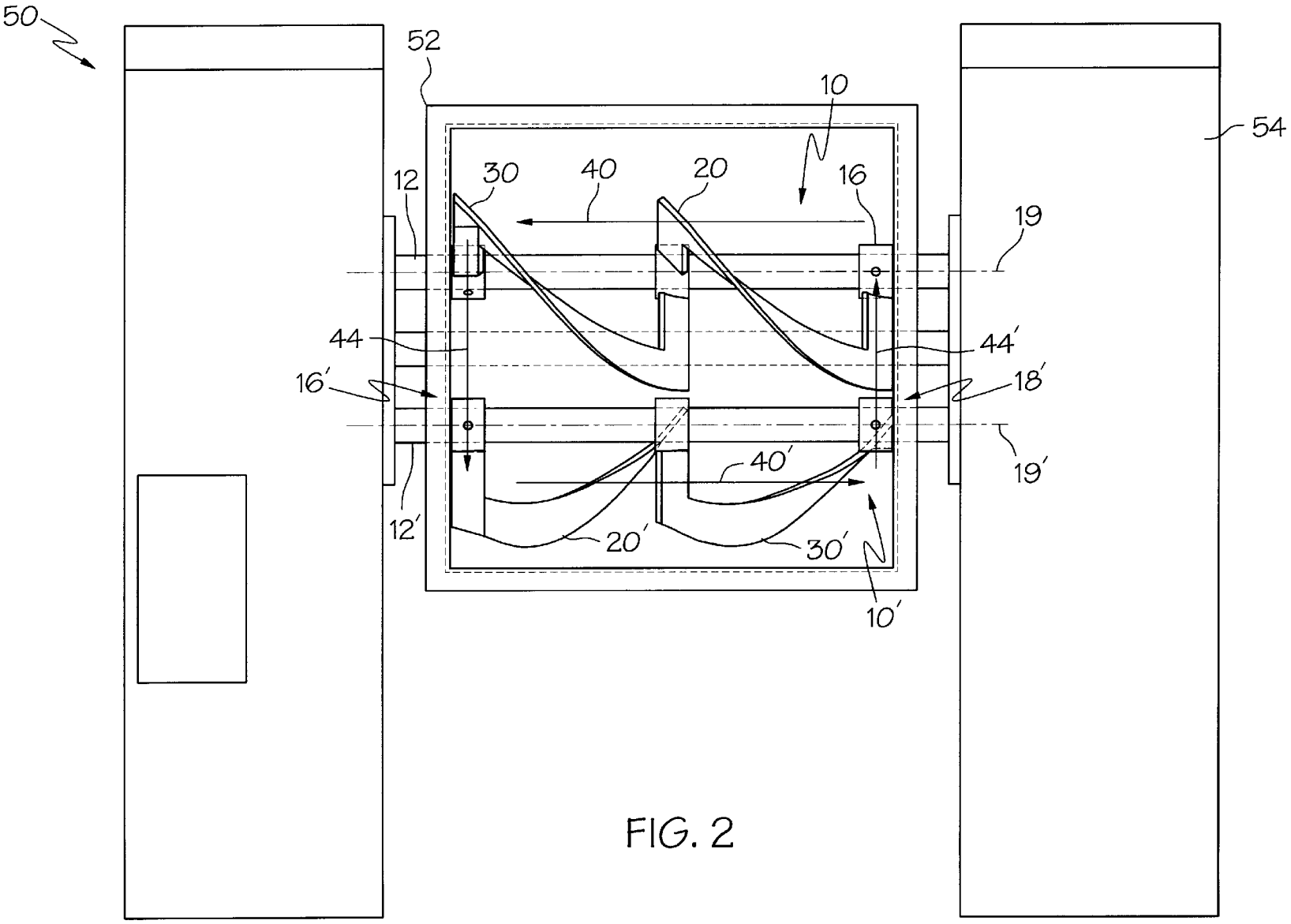
FIG. 2 is a front plan view of an agitator assembly according to the present invention.
Figure 3:
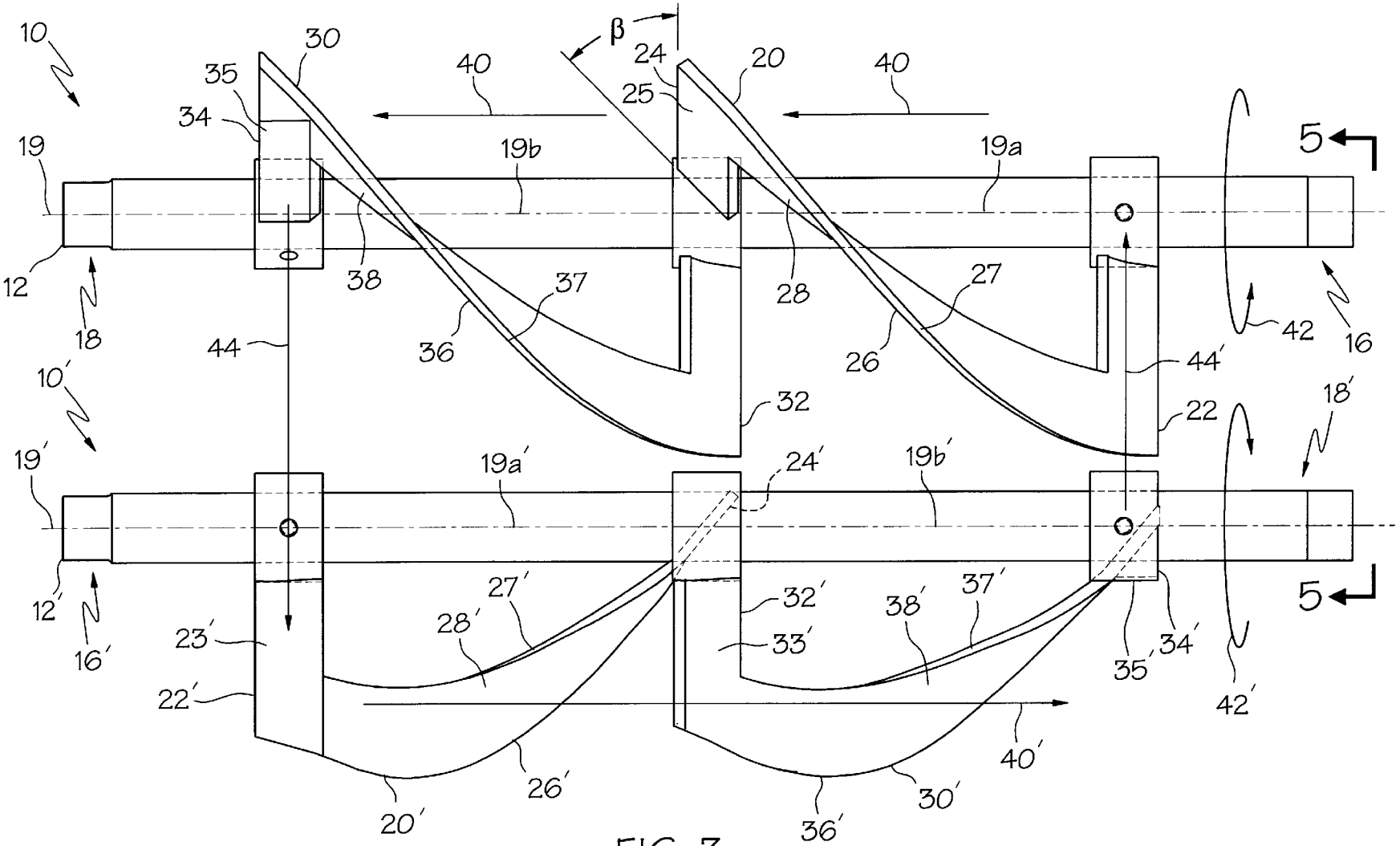
FIG. 3 is a front plan view of a pair of agitators according to the present invention.

The inclination of the first sweep blade origin 22, the first sweep blade terminus 24, the first sweep blade span 26, the second sweep blade origin 32, and the second sweep blade span 36 defines a first flow direction 40 extending from the first end 16 of the agitator shaft 12 to the second end 18 of the agitator shaft. The first flow direction 40 corresponds to rotation of the agitator shaft 12 in a positive direction 42 about the axis of rotation 19. Specifically, the inclination of the various surfaces of the first and second sweep blades 20, 30 is oriented such that rotation of the agitator shaft 12 in the positive direction 42 causes material in which the agitator 10 is positioned to move in the first flow direction 40 from the first end 16 of the agitator shaft 12 towards the second end 18 of the agitator shaft 12. In one embodiment of the present invention, the second sweep blade origin 32 leads the first sweep blade terminus 24 in the positive direction 42. The second sweep blade origin 32 and the first sweep blade terminus 24 are separated by an angle θ that is less than 180°, preferably about 120°, with respect to the axis of rotation 19. It is contemplated by the present invention that the value of the angle θ may vary depending upon the specific mixing application. For example, it is preferred that the angle θ be less than 180° where the agitator 10 is utilized in concert with an adjacent agitator, as is illustrated in FIGS. 2–4.

The second terminal surface 35 is substantially parallel to the axis of rotation 19 and defines a second flow direction 44 that is substantially perpendicular to the first flow direction 40. Specifically, material adjacent or proximate the second terminal surface 35 is directed in the second flow direction 44 upon rotation of the shaft 12 in the positive direction 42 because the second terminal surface 35 is substantially parallel to the axis of rotation 19, as opposed to being inclined with respect to a plane normal to the axis of rotation 19.

The first origin surface 23 is inclined at a first angle α (see FIG. 1), the first terminal surface 25 is inclined at a second angle β (see FIG. 3), and the first angle a is greater than the second angle β. In this manner, the slope of the first sweep blade span 26 decreases from the first end 16 of the agitator shaft 12 in the direction of the second end 18 of the agitator shaft 12. In one embodiment of the present invention, the first angle α is about 50° and the second angle β is about 30°. The second origin surface 33 is inclined at a third angle ω (see FIG. 1). The third angle ω is approximately equal to the first angle α. It is contemplated by the present invention that the specific values of the first angle a and the second angle β may be different than those described herein. Further, the values of these angles need not define a decreasing slope, i.e., the first angle α may be equal to the second angle β. It is noted, however, that the decreasing slope encourages the translation of material adjacent or proximate the sweep blades 20, 30 in the first flow direction 40.

Figure 4:
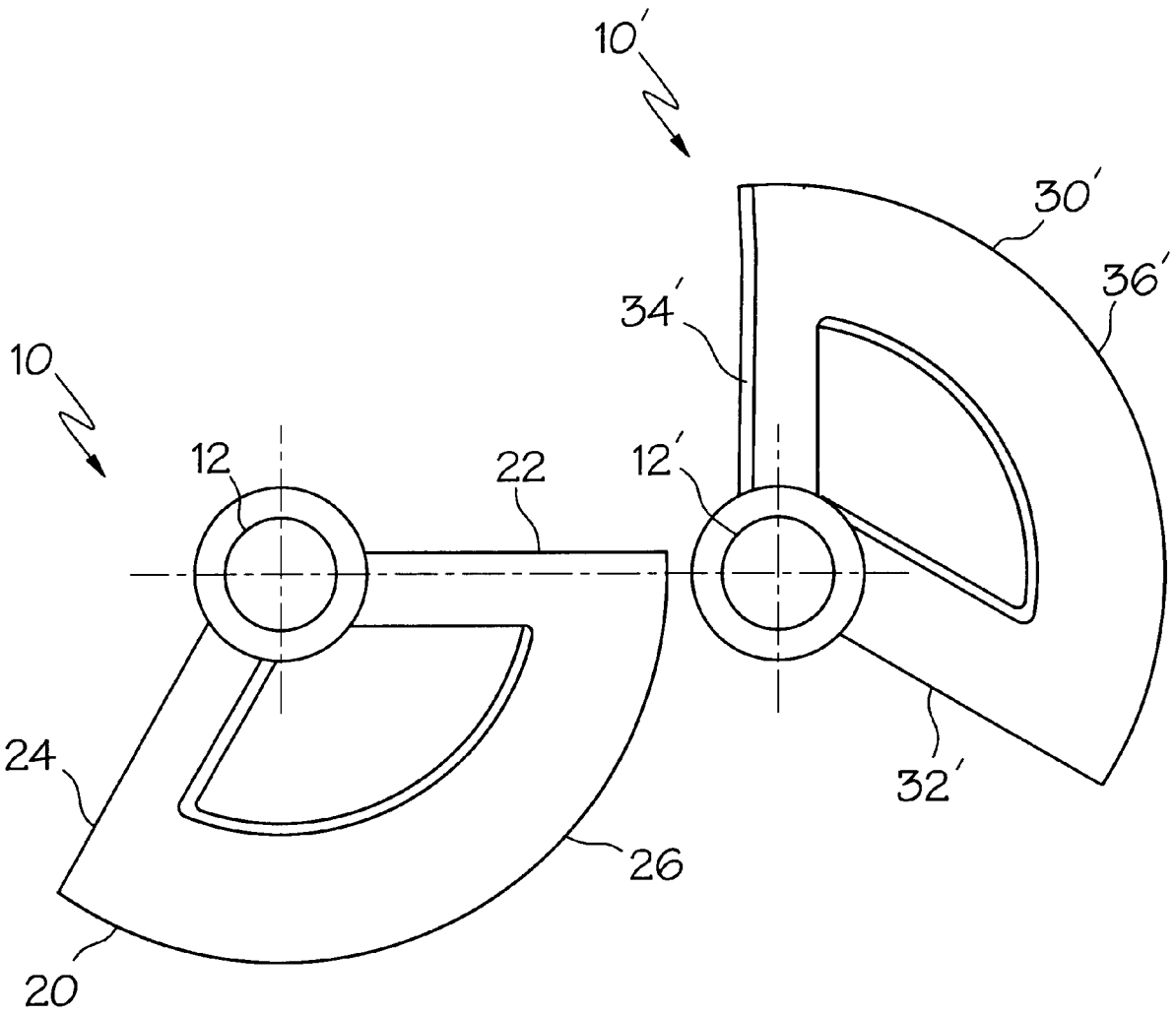
FIG. 4 is a side plan view of the agitators of FIG. 3.
Figure 5:
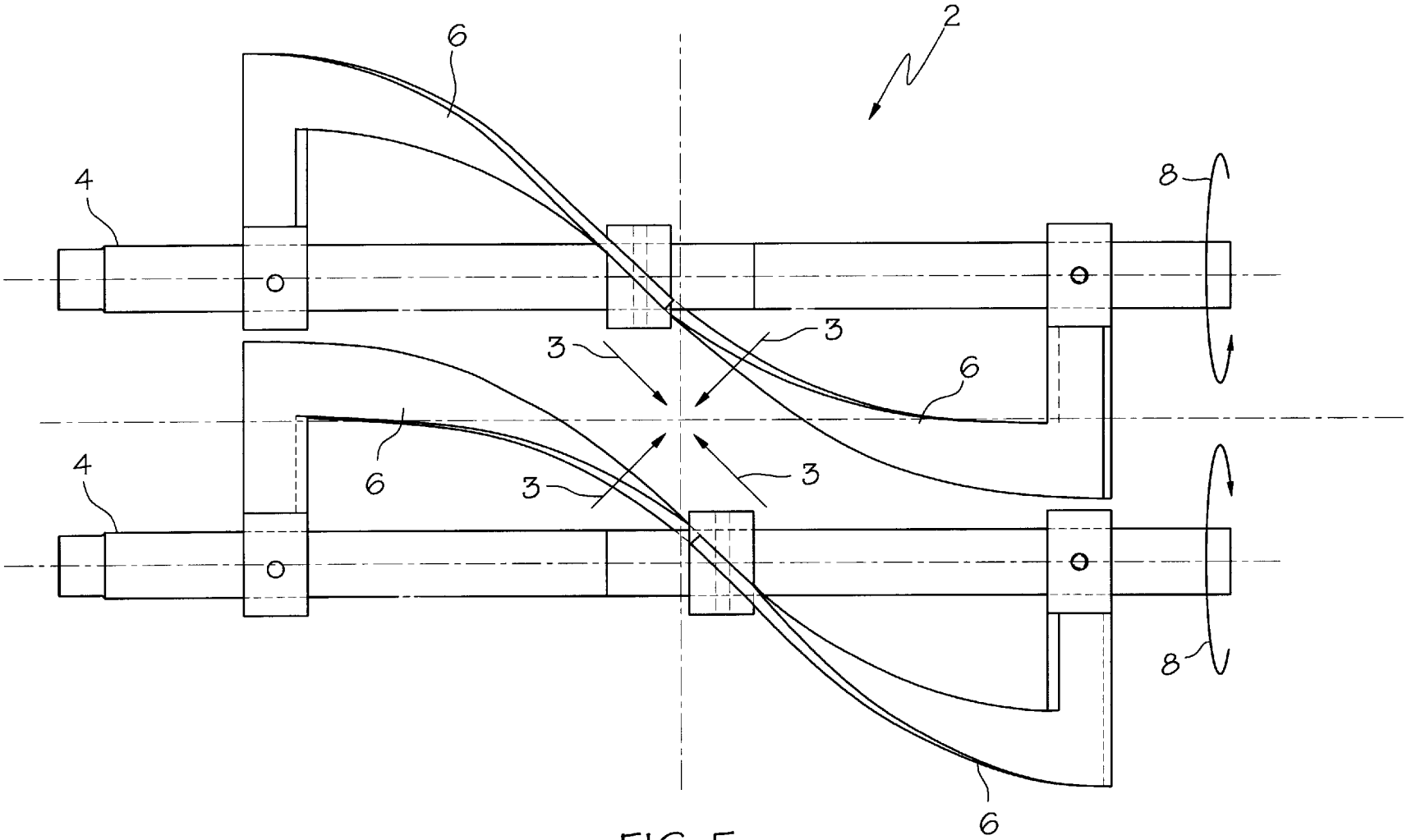
FIG. 5 PRIOR ART
FIG. 5 is an illustration of a prior art agitator assembly.

Referring now specifically to FIGS. 1 and 4, the first sweep blade origin 22 and the first sweep blade terminus 24 are separated by about 120° with respect to the axis of rotation 19. In other words, the first sweep blade 20 twists about the axis 19 and occupies approximately one third of a 360° arc defined about the axis of rotation 19. Similarly, the second sweep blade origin 32 and the second sweep blade terminus 34 are separated by about 120° with respect to the axis of rotation 19. As is illustrated in FIGS. 1 and 4, the first sweep blade 20 and the second sweep blade 30 occupy substantially the same one-third portion of the 360° arc.

The agitator shaft 12 comprises a first hub 13, a second hub 14, and a third hub 15 positioned along the agitator shaft 12 (see FIG. 1). The first sweep blade origin 22 is secured to the first hub 13, the first sweep blade terminus 24 and the second sweep blade origin 32 are secured to the second hub 14, and the second sweep blade terminus 34 is secured to the third hub 15. The second hub 14 is positioned equidistant from the first hub 13 and the third hub 15.

The agitator 10 of the present invention may also be described in terms of its substantially helical shape. Specifically, the first sweep blade 20 extends from the first sweep blade origin 22 to the first sweep blade terminus 24 along a first substantially helical path 27 defined about a first helical axis 19*a* (see FIGS. 1 and 3). Similarly, the second sweep blade 30 extends from the second sweep blade origin 32 to the second sweep blade terminus 34 along a second substantially helical path 37 defined about a second helical axis 19*b*. The respective orientations, i.e., the respective twisting directions, of the first sweep blade 20 along the first substantially helical path 27 and the second sweep blade 30 along the second substantially helical path 37 define the first flow direction 40 extending from the first sweep blade origin 22 to the second sweep blade terminus 34. The second flow direction 44, defined by the second terminal surface 35, is substantially perpendicular to the second helical axis 19*b*. In the illustrated embodiment, the first helical axis 19*a* and the second helical axis 19*b* define a common axis of rotation or common helical axis 19. For the purpose of describing the present invention, it is noted that the common helical axis and the axis of rotation are the same line of reference 19 illustrated in FIGS. 1–4.

Preferably, as is the case in the illustrated embodiment, the slope of the first sweep blade 20 along the first helical path 27, relative to a plane normal to the first helical axis 19*a*, decreases from about 50° at the first sweep blade origin 22 to about 30° at the first sweep blade terminus 24. Similarly, the slope of the second sweep blade 30 along the second helical path 37 decreases from the second sweep blade origin 32 to the second sweep blade terminus 34. The slope at the first sweep blade origin 22 is approximately equal to the slope at the second sweep blade origin 32.

Referring specifically to FIGS. 2–4, an agitator assembly 50 according to the present invention is illustrated. The agitator assembly comprises a first agitator 10, a second agitator 10', a mixing bowl 52 enclosing the first and second agitators 10, 10', and a driving assembly 54 coupled to the first and second agitators 10, 10'. The agitators are rotated within the mixing bowl 52 and rapidly and uniformly mix ingredients held within the bowl 52. The driving assembly 54 is operative to rotate each agitator 10, 10' simultaneously towards one another in a positive or negative direction within the mixing bowl. The mixing bowl 52 may be tilted from an upright mixing position to a tilted dumping position. For the convenience of illustration, the mixing bowl 52 of the agitator assembly 50 illustrated in FIG. 2 is in the tilted position.

The first agitator 10 is as described above with reference to FIGS. 1–4. The second agitator 10' (see FIG. 3) is oriented substantially parallel to the first agitator 10 and comprises a third sweep blade 20' mechanically coupled to a fourth sweep blade 30'. The third sweep blade 20' extends from a third sweep blade origin 22' to a third sweep blade terminus 24' along a third substantially helical path 27' defined about a third helical axis 19*a*'. The fourth sweep blade 30' extends from a fourth sweep blade origin 32' to a fourth sweep blade terminus 34' along a fourth substantially helical path 37' defined about a fourth helical axis 19*b*'. The respective orientations of the third sweep blade 20' along the third substantially helical path 27' and the fourth sweep blade 30' along the fourth substantially helical path 37' define a return flow direction 40' extending from the third sweep blade origin 22' to the fourth sweep blade terminus 34'. Although the first agitator 10 and the second agitator 10' are substantially identical in structure, the second sweep blade terminus 34 and the fourth sweep blade terminus 34' are positioned at opposite ends of the mixing bowl 52. Further, the position of the second agitator 10' is rotated relative to the first agitator 10 such that the agitators 10, 10' do not collide as they are rotated. The degree at which the agitators 10, 10' are rotated relative to one another is also dependent upon the degree to which the sweep blades 20, 30, 20', 30' are twisted about the respective axes of rotation 19, 19'.

The return flow direction 40' corresponds to rotation of the agitator shaft 12' in a positive direction 42' about the axis of rotation 19'. The inclination of the third and fourth sweep blades 20', 30' is oriented such that rotation of the agitator shaft 12' in the positive direction 42' causes material in which the agitator 10' is positioned to move in the return flow direction 40' from the first end 16' of the agitator shaft 12' towards the second end 18' of the agitator shaft 12'. For the purposes of describing and defining the present invention, the positive direction 42' corresponds to rotation of the agitator shaft 12' such that material at the top of the mixing bowl 52 is generally urged in the return flow direction 40 and towards the opposite agitator shaft 12 within the mixing bowl 52. Similarly, the positive direction 42 corresponds to rotation of the agitator shaft 12 such that material at the top of the mixing bowl 52 is generally urged in the first flow direction 40 and towards the opposite agitator shaft 12' within the mixing bowl 52. The return flow direction 40' is opposite the first flow direction 40, as is indicated in FIG. 3. It is contemplated by the present invention that, during a mixing operation, the driving assembly 54 may cause the agitator shafts 10, 10' to rotate in the positive directions 42, 42' and subsequently to rotate in the opposite or negative directions for predetermined periods of time.

The fourth sweep blade terminus 34' includes a fourth terminal surface 35' that is substantially parallel to the fourth helical axis **19*b*'. The fourth terminal surface 35' defines a second return flow direction 44' that is substantially perpendicular to the return flow direction 40'. Specifically, material adjacent or proximate the fourth terminal surface 35' is directed in the second return flow direction 44' upon rotation of the shaft 12' in the positive direction 42' because the fourth terminal surface 35' is substantially parallel to the axis of rotation 19', as opposed to being inclined with respect to a plane normal to the axis of rotation 19'**.

Accordingly, the respective orientations of the first sweep blade 20, the second sweep blade 30, the second terminal surface 35, the third sweep blade 20', the fourth sweep blade 30'. and the fourth terminal surface 35' define a circuitous flow path extending from the first sweep blade origin 22, past the first, second, third and fourth sweep blades 20, 30, 20', 30' and returning to the first sweep blade origin 22. The circuitous flow path comprises, and is illustrated by, the first flow direction 40, the second flow direction 44, the return flow direction 40', and the second return flow direction 44'. The circuitous nature of the flow path encourages mixing uniformity and enhances the rate at which materials held within the bowl 52 are mixed.

It is contemplated by the present invention that, although the parallel orientation of the terminal surfaces 35, 35' improve the circuitous nature of the circuitous flow path, a substantially circuitous flow path could also be achieved absent the parallel terminal surfaces 35, 35'. It is also contemplated by the present invention that, although the movement of material within the mixing bowl 52 is described in terms of the first flow direction 40, the second flow direction 44, the return flow direction 40', and the second return flow direction 44', as will be appreciated by those practicing the present invention, a substantial number of other flow directions are defined by the orientation and movement of the sweep blades 20, 30, 20', 30' within the mixing bowl. For example, some material within the mixing bowl 52 will also tend to flow from the third sweep blade 20' in the direction of the first sweep blade 20. Further, it is contemplated by the present invention that the positions of the sweep blades 20, 30, 20', 30' within the mixing bowl 52 can be changed to change the direction, orientation, or position of the circuitous flow path. Finally, it is contemplated by the present invention that the direction of rotation of the agitators 10, 10' can be selectively altered to alter the mixing activity within the bowl 52.

It is noted that, to improve mixing efficiency within the mixing bowl, the first, second, third and fourth sweep blades 20, 30, 20', 30' are displaced from the corresponding agitator shaft 12, 12' by blade support members 46. Although the orientation of each support member preferably corresponds to the orientation of that portion of the blade that it supports, it is contemplated by the present invention that a variety of support member designs may be incorporated in the present invention.

It is contemplated by the present invention that the agitator shafts 12, 12' need not be continuous and linear, as is illustrated in FIGS. 1–4. Rather, the agitator shafts 12, 12' may be non-linear and discontinuous, depending upon the design preferences of those practicing the present invention.

Having described the invention in detail and by reference to preferred embodiments thereof, it will be apparent that modifications and variations are possible without departing from the scope of the invention defined in the appended claims.

What is claimed is:

1. An agitator comprising:

an agitator shaft defining an axis of rotation extending from a first end of said agitator shaft to a second end of said agitator shaft;

a first sweep blade mounted to said agitator shaft, wherein said first sweep blade includes a first sweep blade origin secured to said agitator shaft proximate said first end of said agitator shaft, said first sweep blade origin defining a first origin surface, wherein said first origin surface is inclined relative to a plane normal to said axis of rotation, a first sweep blade terminus defining a first terminal surface, wherein said first terminal surface is inclined relative to a plane normal to said axis of rotation, and a first sweep blade span extending from said first sweep blade origin to said first sweep blade terminus, wherein said first sweep blade span defines a first span surface, wherein said first span surface is inclined relative to a plane normal to said axis of rotation; and a second sweep blade mounted to said agitator shaft, wherein said second sweep blade includes a second sweep blade origin defining a second origin surface, wherein said second origin surface is inclined relative to a plane normal to said axis of rotation, a second sweep blade terminus secured to said agitator shaft proximate said second end of said agitator shaft, said second sweep blade terminus defining a second terminal surface, and a second sweep blade span extending from said second sweep blade origin to said second sweep blade terminus, wherein said second sweep blade span defines a second span surface, wherein said second span surface is inclined relative to a plane normal to said axis of rotation.

2. An agitator as claimed in claim 1 wherein the inclination of said first sweep blade origin, said first sweep blade terminus, said first sweep blade span, said second sweep blade origin, and said second sweep blade span is arranged to create a first flow direction extending from one end of said agitator shaft to another end of said agitator shaft.

3. An agitator as claimed in claim 2 wherein said first flow direction extends from said first end of said agitator shaft to said second end of said agitator shaft.

4. An agitator as claimed in claim 3 wherein said first flow direction corresponds to rotation of said agitator shaft in a positive direction about said axis of rotation, wherein said second sweep blade origin leads said first sweep blade terminus in said positive direction, and wherein said second sweep blade origin and said first sweep blade terminus are separated by less than 180° with respect to said axis of rotation.

5. An agitator as claimed in claim 4 wherein said second sweep blade origin and said first sweep blade terminus are separated by about 120° with respect to said axis of rotation.

6. An agitator as claimed in claim 1 wherein said second terminal surface is substantially parallel to said axis of rotation and defines a second flow direction substantially perpendicular to said first flow direction.

7. An agitator as claimed in claim 1 wherein said first origin surface is inclined at a first angle, wherein said first terminal surface is inclined at a second angle, and wherein said first angle is greater than said second angle such that the slope of said first sweep blade decreases from said first end of said agitator shaft in the direction of said second end of said agitator shaft.

8. An agitator as claimed in claim 7 wherein said first angle is about 50° and said second angle is about 30°.

9. An agitator as claimed in claim 7 wherein said second origin surface is inclined at a third angle and wherein said third angle is approximately equal to said first angle.

10. An agitator as claimed in claim 1 wherein said first sweep blade origin and said first sweep blade terminus are separated by about 120° with respect to said axis of rotation, such that said first sweep blade occupies approximately one third of a 360° arc defined about said axis of rotation.

11. An agitator as claimed in claim 10 wherein said second sweep blade origin and said second sweep blade terminus are separated by about 120° with respect to said axis of rotation, such that said second sweep blade occupies approximately one third of said 360° arc.

12. An agitator as claimed in claim 11 wherein said first sweep blade and said second sweep blade occupy substantially the same portion of said 360° arc.

13. An agitator as claimed in claim 1 wherein said agitator shaft comprises a substantially linear agitator shaft.

14. An agitator as claimed in claim 1 wherein said agitator shaft comprises a first hub, a second hub, and a third hub positioned along said agitator shaft and wherein said first sweep blade origin is secured to said first hub, said first sweep blade terminus and said second sweep blade origin are secured to said second hub, and said second sweep blade terminus is secured to said third hub.

15. An agitator as claimed in claim 14 wherein said second hub is positioned equidistant from said first hub and said third hub.

16. An agitator comprising a first sweep blade mechanically coupled to a second sweep blade, wherein:

said first sweep blade extends from a first sweep blade origin to a first sweep blade terminus along a first substantially helical path defined about a first helical axis;

said second sweep blade extends from a second sweep blade origin to a second sweep blade terminus along a second substantially helical path defined about a second helical axis;

the respective orientations of said first sweep blade along said first substantially helical path and said second sweep blade along said second substantially helical path define a first flow direction extending from said first sweep blade origin to said second sweep blade terminus; and wherein said first sweep blade terminus includes a first terminal surface that is inclined relative to a plane normal to said first helical axis.

17. An agitator comprising a first sweep blade mechanically coupled to a second sweep blade, wherein:

said first sweep blade extends from a first sweep blade origin to a first sweep blade terminus along a first substantially helical path defined about a first helical axis;

said second sweep blade extends from a second sweep blade origin to a second sweep blade terminus along a second substantially helical path defined about a second helical axis:

said first helical axis and said second helical axis define a common helical axis;

said first sweep blade origin and said second sweep blade terminus are positioned at opposite ends of said common helical axis;

the respective orientations of said first sweep blade along said first substantially helical path and said second sweep blade along said second substantially helical path define a first flow direction extending from said first sweep blade origin to said second sweep blade terminus; and wherein said first sweep blade terminus and said second sweep blade origin are positioned at substantially the same point along said common helical axis.

18. An agitator as claimed in claim 17 wherein said first sweep blade origin and said first sweep blade terminus are separated by about 120° with respect to said common helical axis, such that said first sweep blade occupies approximately one third of a 360° arc defined about said common helical axis.

19. An agitator as claimed in claim 18 wherein said second sweep blade origin and said second sweep blade terminus are separated by about 120° with respect to said common helical axis, such that said second sweep blade occupies approximately one third of said 360° arc.

20. An agitator as claimed in claim 19 wherein said first sweep blade and said second sweep blade occupy substantially the same one third portion of said 360° arc.

21. An agitator comprising a first sweep blade mechanically coupled to a second sweep blade, wherein:

said first sweep blade extends from a first sweep blade origin to a first sweep blade terminus along a first substantially helical path defined about a first helical axis;

said second sweep blade extends from a second sweep blade origin to a second sweep blade terminus along a second substantially helical path defined about a second helical axis;

said second sweep blade terminus includes a second terminal surface that is substantially parallel to said second helical axis and wherein said second terminal surface is arranged to create a second flow direction substantially perpendicular to said second helical axis; and wherein the respective orientations of said first sweep blade along said first substantially helical path and said second sweep blade along said second substantially helical path are arranged to create a first flow direction extending from said first sweep blade origin to said second sweep blade terminus.

22. An agitator as claimed in claim 21 wherein said flow direction corresponds to rotation of said first sweep blade and said second sweep blade in a positive direction about a common helical axis, wherein said second sweep blade origin leads said first sweep blade terminus in said positive direction, and wherein said second sweep blade origin and said first sweep blade terminus are separated by less than 180° with respect to said common helical axis.

23. An agitator as claimed in claim 21 wherein the slope of said first sweep blade along said first helical path relative to a plane normal to said first helical axis, decreases from said first sweep blade origin to said first sweep blade terminus.

24. An agitator as claimed in claim 23 wherein said slope decreases from about 50° to about 30°.

25. An agitator as claimed in claim 20 wherein the slope of said second helical path decreases from said second sweep blade origin to said second sweep blade terminus, and wherein the slope at said first sweep blade origin is approximately equal to the slope at said second sweep blade origin.

26. An agitator assembly comprising:

a first agitator comprising a first sweep blade mechanically coupled to a second sweep blade, wherein said first sweep blade extends from a first sweep blade origin to a first sweep blade terminus along a first substantially helical path defined about a first helical axis, said second sweep blade extends from a second sweep blade origin to a second sweep blade terminus along a second substantially helical path defined about a second helical axis, and wherein the respective orientations of said first sweep blade along said first substantially helical path and said second sweep blade along said second substantially helical path are arranged to create a first flow direction extending from said first sweep blade origin to said second sweep blade terminus;

a second agitator oriented substantially parallel to said first agitator, said second agitator comprising a third sweep blade mechanically coupled to a fourth sweep blade, wherein said third sweep blade extends from a third sweep blade origin to a third sweep blade terminus along a third substantially helical path defined about a third helical axis, said fourth sweep blade extends from a fourth sweep blade origin to a fourth sweep blade terminus along a fourth substantially helical path defined about a fourth helical axis, the respective orientations of said third sweep blade along said third substantially helical path and said fourth sweep blade along said fourth substantially helical path are arranged to create a return flow direction extending from said third sweep blade origin to said fourth sweep blade terminus, and wherein said return flow direction is opposite said first flow direction;

a mixing bowl enclosing said first and second agitators; and a driving assembly coupled to said first and second agitators.

27. An agitator assembly as claimed in claim 26 wherein:

said second sweep blade terminus includes a second terminal surface that is substantially parallel to said second helical axis;

said fourth sweep blade terminus includes a fourth terminal surface that is substantially parallel to said fourth helical axis; and wherein the respective orientations of said first sweep blade, said second sweep blade, said second terminal surface, said third sweep blade, said fourth sweep blade, and said fourth terminal surface define a substantially circuitous flow path extending from said first sweep blade origin, past said second, third and fourth sweep blades, and returning to said first sweep blade origin.

28. An agitator assembly as claimed in claim 26 wherein said first agitator and said second agitator are substantially identical in structure and wherein said second sweep blade terminus and said fourth sweep blade terminus are positioned at opposite ends of said mixing bowl.

29. An agitator assembly as claimed in claim 26 wherein said driving assembly is operative to rotate said first and second agitators in a negative direction.

* * * * *